United States Patent [19]

German et al.

[11] Patent Number: 4,510,716

[45] Date of Patent: Apr. 16, 1985

[54] GRINDING MACHINE HAVING IMPROVED DRESSING MEANS

[75] Inventors: Martin A. German, Holden, Mass.; Joseph F. Volk, Chagrin Falls, Ohio

[73] Assignee: The Warner & Swasey Co., Cleveland, Ohio

[21] Appl. No.: 506,076

[22] Filed: Jun. 20, 1983

Related U.S. Application Data

[62] Division of Ser. No. 228,424, Jan. 26, 1981, Pat. No. 4,443,975.

[51] Int. Cl.[3] ..... B24B 5/12

[52] U.S. Cl. ..... 51/5 D; 51/95 WH

[58] Field of Search ..... 51/5 D, 3, 95, 165.71, 51/289 R, 105 SP, 49, 325, 165.8; 125/11 R

[56] References Cited

U.S. PATENT DOCUMENTS

| | | | |
|---|---|---|---|
| 2,748,540 | 6/1956 | St. George | 51/95 WH |
| 3,353,302 | 11/1967 | Lowy | 51/49 |
| 3,857,200 | 12/1974 | Hill | 51/5 D |
| 4,265,054 | 5/1981 | Ito | 51/5 D |

*Primary Examiner*—Frederick R. Schmidt
*Assistant Examiner*—Robert Rose

[57] ABSTRACT

An automatic external cylindrical grinding center (10), having a pair of driven grinding wheels (86, 88) capable of straight and angular wheel feed for grinding a workpiece in on-center or chucking configurations. The grinding center (10) has a base (16) with a swivel table (20) pivotally mounted thereon. A longitudinally positionable work head (24) and footstock (26) are mounted on the base (16). A carriage (56) is slidably mounted on ways (52, 54) which extend longitudinally on the base (16). A pair of rearward extending ways (72, 74) are provided on top of the carriage (56) to support a wheel slide assembly (76) for back and forth movement. A rotatable wheel head (84) is mounted from the wheel slide (76) and supports two driven grinding wheels (86, 88) mounted thereon. The rotatable wheel head (84) is positionable at various positions to bring either grinding wheel (86, 88) into position for contacting the workpiece. The carriage (56) and wheel slide assembly (76) are movable along their respective axes in response to a programmable controller. The orthogonal feed axes can be selectively programmed to operate independently or simultaneously at independent or related feed rates permitting use of the machine as a straight plunge or an angular feed grinding machine. A carriage traverse guide (66) extending parallel to the longitudinal ways (52, 54) is located to minimize effects of machine base thermal distortions. Two fixed dressing diamonds (36, 38) are mounted to the footstock (26) for dressing the grinding wheels (86, 88). Dressing is accomplished by moving the carriage (56) and wheel slide assembly (76) along a selected path at programmed rates and distances to produce the desired wheel contours.

8 Claims, 11 Drawing Figures

GRINDING MACHINE HAVING IMPROVED DRESSING MEANS

This application is a division, of application Ser. No. 228,424, filed Jan. 26, 1981 now U.S. Pat. No. 4,443,975.

BACKGROUND OF THE INVENTION

1. Technical Field

This invention relates to grinding machines and more particularly to a dual wheel external cylindrical grinding machine having the capability of both straight and angular wheel feed.

2. Background Art

Angular feed grinding machines are well known in the art. U.S. Pat. No. 4,205,488 is exemplary of an angular feed grinding machine. Straight feed grinding machines are also well known in the art. U.S. Pat. No. 3,076,296 teaches a straight feed grinding machine.

DISCLOSURE OF THE INVENTION

The present invention provides an external cylindrical grinding machine capable of straight and angular wheel feed. The grinding machine has a pair of independently driven grinding wheels mounted on a grinding wheel head assembly which can be swiveled to various stop points to bring either one of the wheels into position for grinding a workpiece. The grinding machine includes a base which supports a swivel table, having a footstock and a driven work head mounted thereon, and a pair of flat longitudinally extending ways disposed behind the swivel table. A carriage is supported for movement along the longitudinal ways. The carriage is driven by a preloaded nut and ball screw arrangement powered by a servomotor. An incremental encoder, which is operable with the ball screw, provides information which is used for positioning the carriage. An elongated carriage traverse guide is provided substantially beneath the work piece location for guiding carriage movement and minimizing the effect of base thermal distortions. The carriage traverse guide permits the use of two flat ways for supporting the carriage. A pair of rearwardly extending ways, which support an upper wheel slide for back and forth movement relative to the swivel table, are provided on top of the carriage. The wheel head assembly is supported from the wheel slide for indexing movement about a pivot connection to bring either of the driven grinding wheels into position for grinding the workpiece.

The wheel slide is positioned with respect to the carriage by a preloaded nut and ball screw assembly which is driven by a servomotor. An incremental encoder, which is operable with the wheel slide ball screw, provides information which is used for positioning the wheel slide. The axis of movement of the wheel slide is orthogonal to the axis of movement of the carriage along the base.

Two fixed diamonds are mounted on the footstock for dressing the grinding wheels. Dressing is accomplished by moving the carriage and wheel slides in a programmed manner to produce the desired wheel contour which may involve combinations of straight step diameters, angles, chamfers and radii. Two dressing diamonds or dressing diamond positions are required on the footstock for dressing the various grinding wheel surfaces. The use of two dressing diamonds permits contouring of the grinding wheel from two directions. The offset between the two dressing diamonds can be entered into the machine controller to permit this bidirectional contouring. In place of the two dressing diamonds, one diamond which is movable between the two dressing positions may be utilized.

The disclosed grinding center includes a computerized numerical control (CNC) controller having a programmable micro computer for controlling various machine functions. The carriage and wheel slide orthogonal feed axes can be selectively programmed to act independently or simultaneously, at independent or related feed rates, permitting use of the grinding machine as a straight plunge grinder or as an angle feed grinder. The simultaneous axes motion permits contour dressing and grinding of forms such as angles, radii, and chamfers. The disclosed machine is very versatile and can do work frequently requiring two or three separate machines.

One of the principal advantages of applicant's invention is the ability to quickly dress an altered or entirely new complex shape into the dressing wheels. Until applicant's invention, the dressing of complex shapes on a grinding wheel involved the use of a template arrangement, such as that taught in U.S. Pat. No. 2,900,974. Any change in the complex shape being dressed onto the grinding wheel involved a change of template, an operation generally taking up to 4 hours or more. With the dressing apparatus of applicant's invention, this can now be achieved in a matter of a few minutes.

BRIEF DESCRIPTION OF THE DRAWINGS

For a better understanding of the invention, reference may be had to the preferred embodiment exemplary thereof shown in the accompanying drawings in which.

BEST MODE FOR CARRYING OUT THE INVENTION

Figure 1:
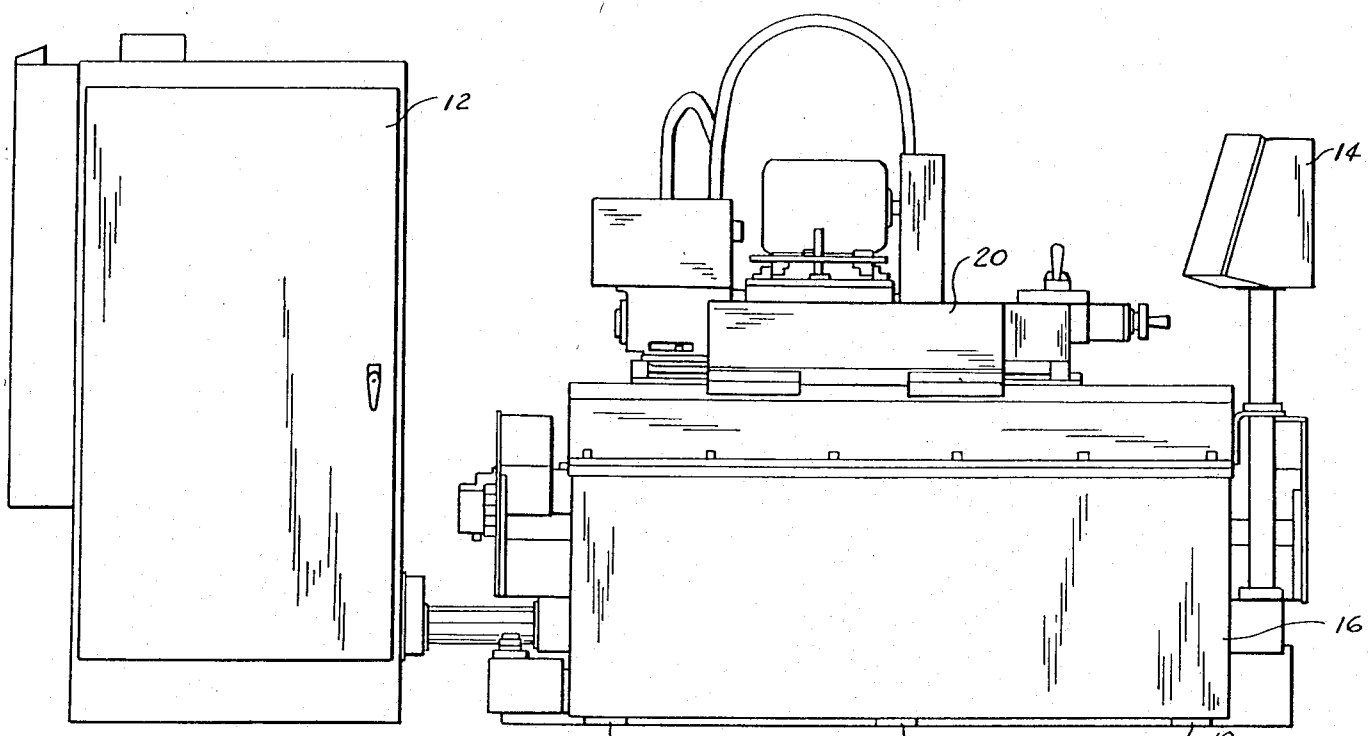
FIG. 1 is a front view of a grinding center constructed according to the teaching of the present invention.
Figure 2:
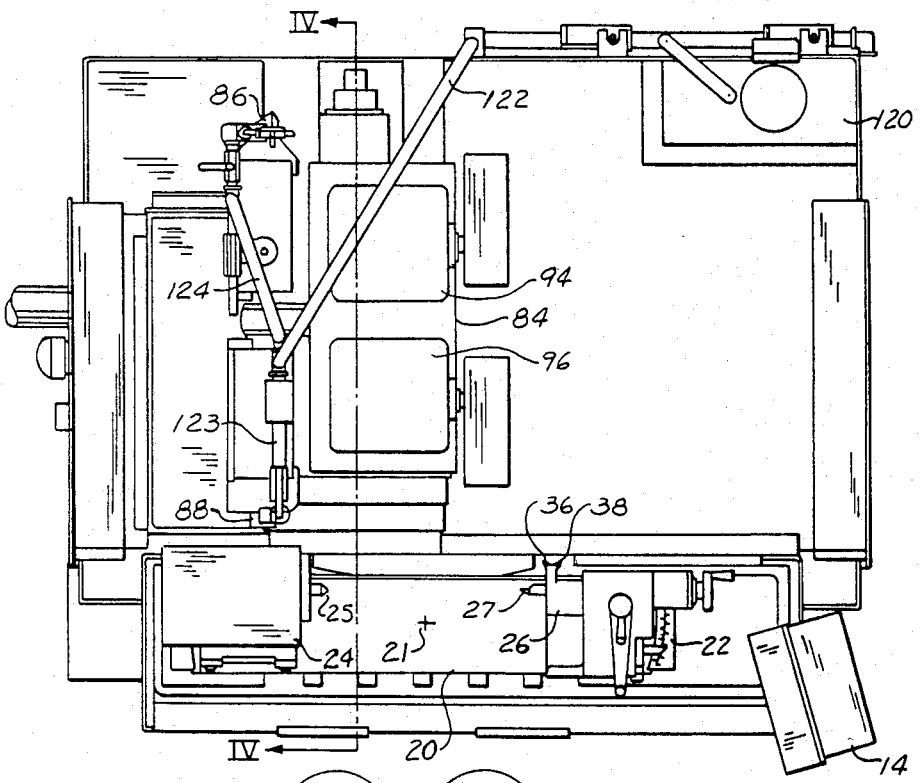
FIG. 2 is a plan view of the grinding machine shown in FIG. 1.
Figure 3:
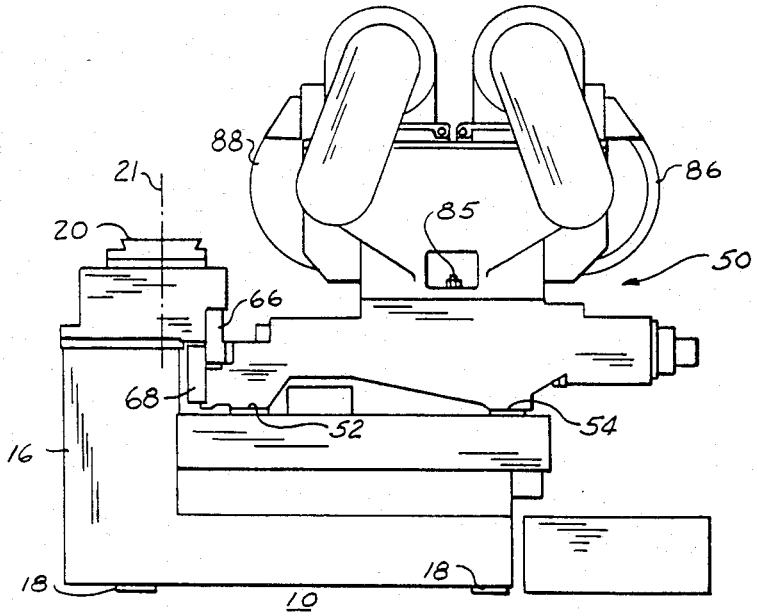
FIG. 3 is a right side view of the grinding machine shown in FIG. 1.
Figure 4:
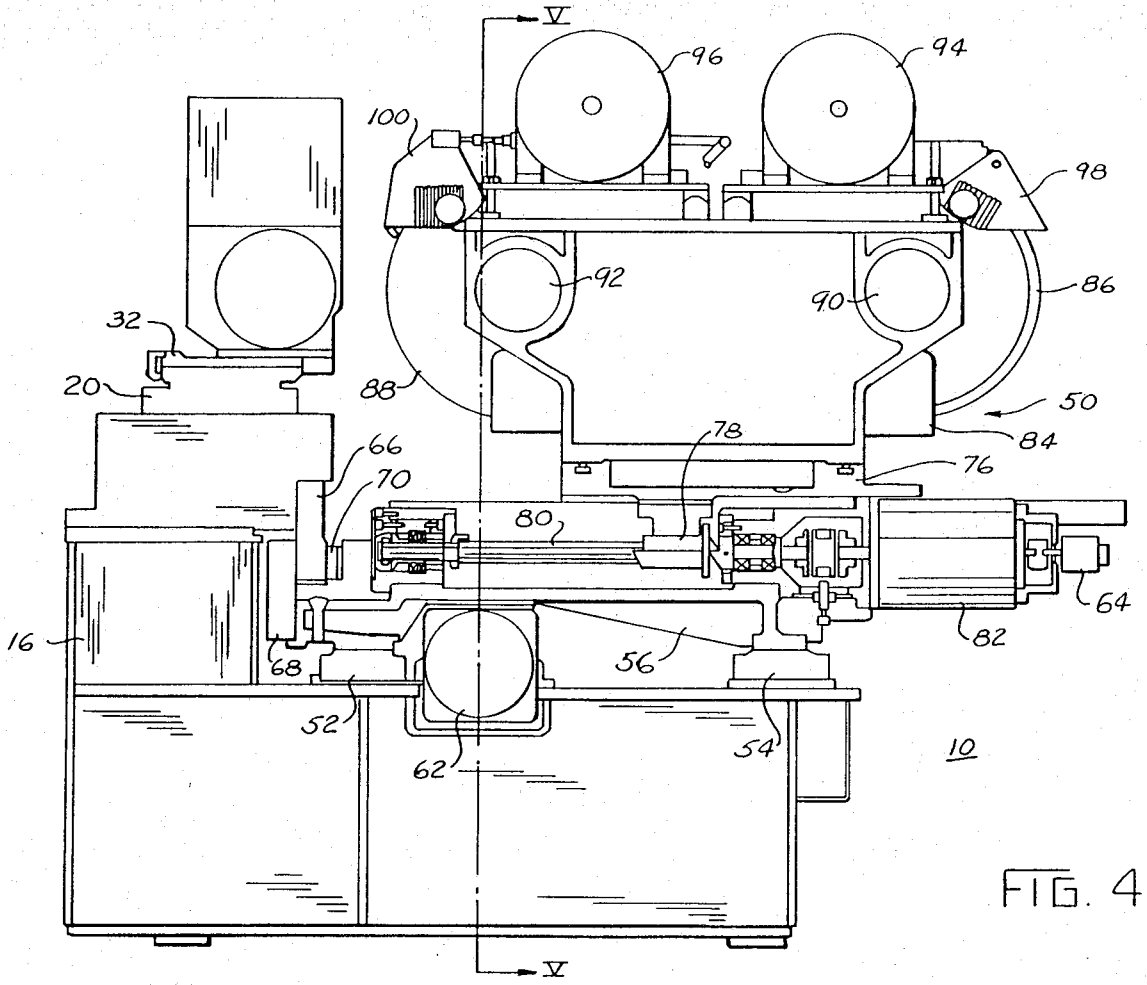
FIG. 4 is a section view taken in FIG. 2 along the line IV—IV, with some items deleted or shown schematically for clarity.
Figure 5:
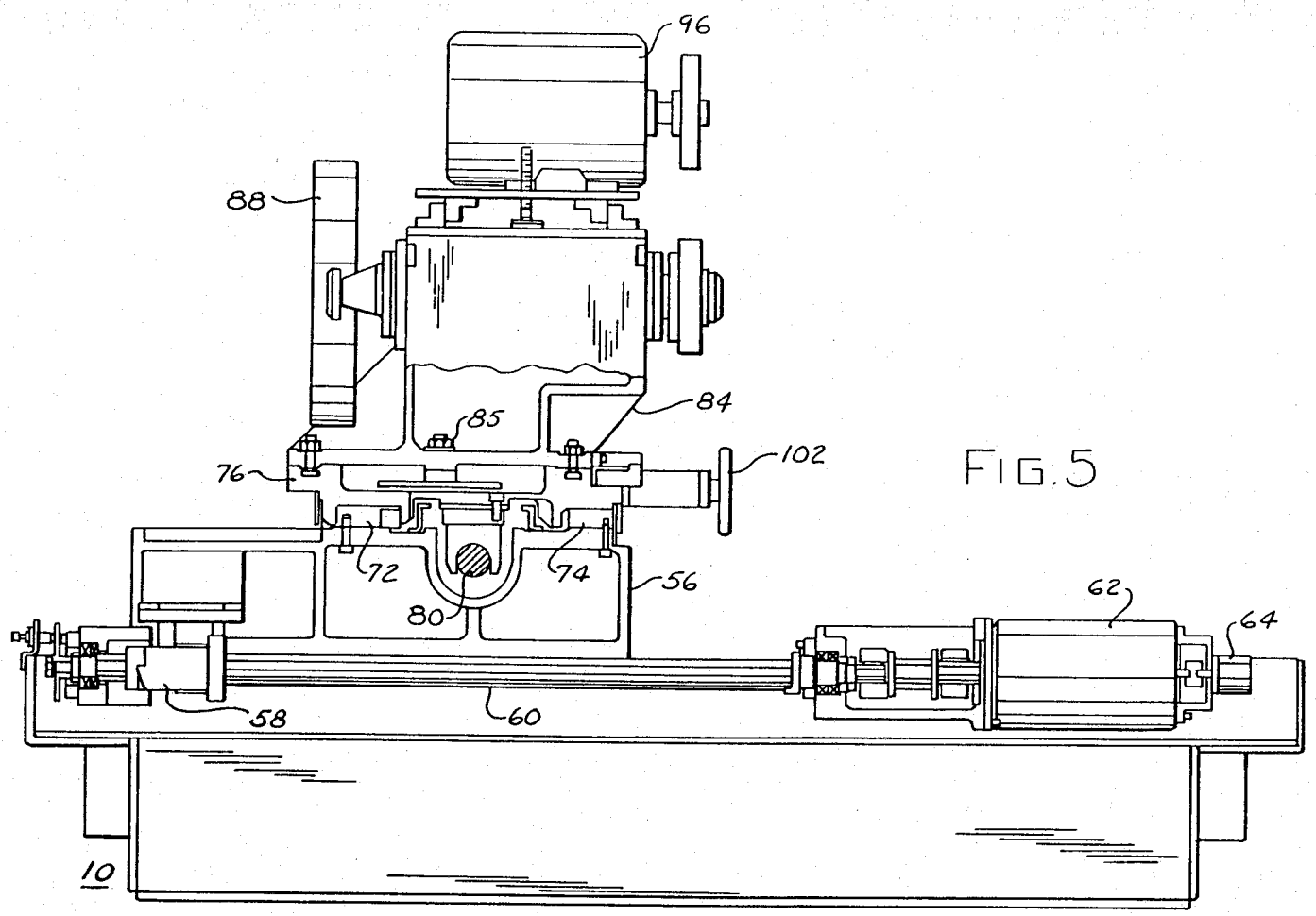
FIG. 5 is a section view taken in FIG. 4 along the line V—V.

Referring now to the drawings, there is shown a dual wheel grinding center 10 constructed according to the teaching of the present invention. The disclosed dual wheel automatic external grinding center 10 is capable of both straight and angled wheel feed.

Programmable controller 12 which receives input data through an input station 14 controls various functions of grinding center 10. Grinding center 10 includes a base 16 on which is supported a swivel table 20 and a grinding head assembly 50. A fluid coolant system 120 is provided for supplying coolant during operation of grinding center 10. When grinding center 10 is installed, three pads 18 support base 16 from a floor.

Swivel table 20 is mounted to base 16 for adjustable positioning about an axis 21 defined by a pivot connection. Graduated scale 22 is provided to indicate the adjusted position of swivel table 20. Swivel table 20 is adjustable through a 20° range about a longitudinal axis of base 16. A work head 24 and a spaced apart footstock 26 are supported on swivel table 20. Work head 24 and footstock 26 include centers 25 and 27 respectively for supporting a workpiece therebetween. Work head 24 includes spindle drive motor 28 which through a belt drive rotates a work driver plate 30 at speeds of 50 to 1000 r.p.m. Work head 24 is supported from a work head support plate 32 and is adjustably fastened by suitable means thereto. Work head support 32 is secured to swivel table 20. The position of work head 24 relative to work plate 32 is manually adjustable about a pivot pin connection 34. That is, work head 24 can manually be positioned relative to work head plate 32 around pin connection 34. Graduations are provided on either side of the zero reference position of workhead 24 to facilitate accurate positioning. The pcsition of work head plate 32 is adjustable longitudinally along swivel table 20. Thus, work head 24 can be used for either chucking work or between center work. The work head 24 is a combination live and dead spindle design which permits supporting of the workpiece on dead centers while driving the workpiece from the work driver plate 30 through a drive dog and drive pin set-up, or operation as a live spindle arrangement while either chucking the workpiece or having it clamped to a face plate.

Work head motor 28, through a plurality of V-belts 40, drives a sheave 42. Sheave 42 is supported by bearings from a portion of work head 24 which supports o motor 28 Center 25, which is a #10 Jarno, is rotatably supported within this same portion of work head 24. Work driver plate 30 is connected to rotate with sheave 42.

Figure 6:
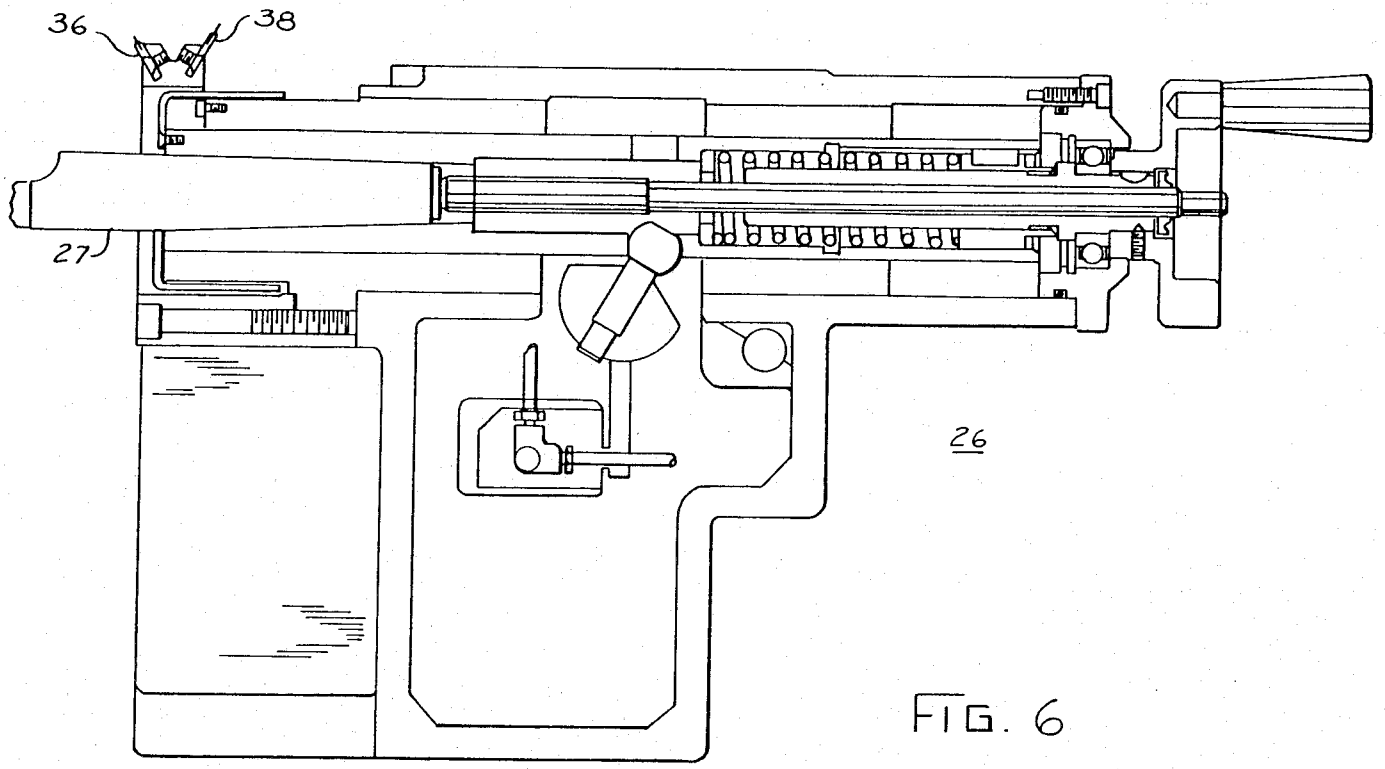
FIG. 6 is a section view through the tailstock showing the pair of dressing diamonds.
Figure 7:
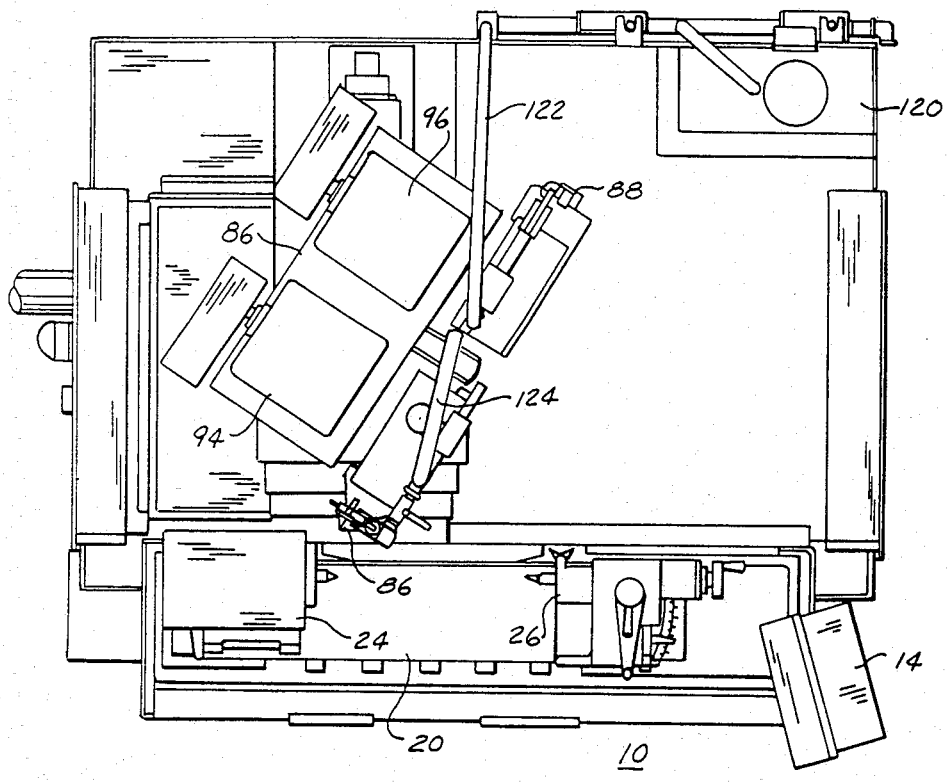
FIG. 7 is a view similar to FIG. 2 but with the wheel head moved to a position for angle feed of the grinding wheel.
Figure 8:
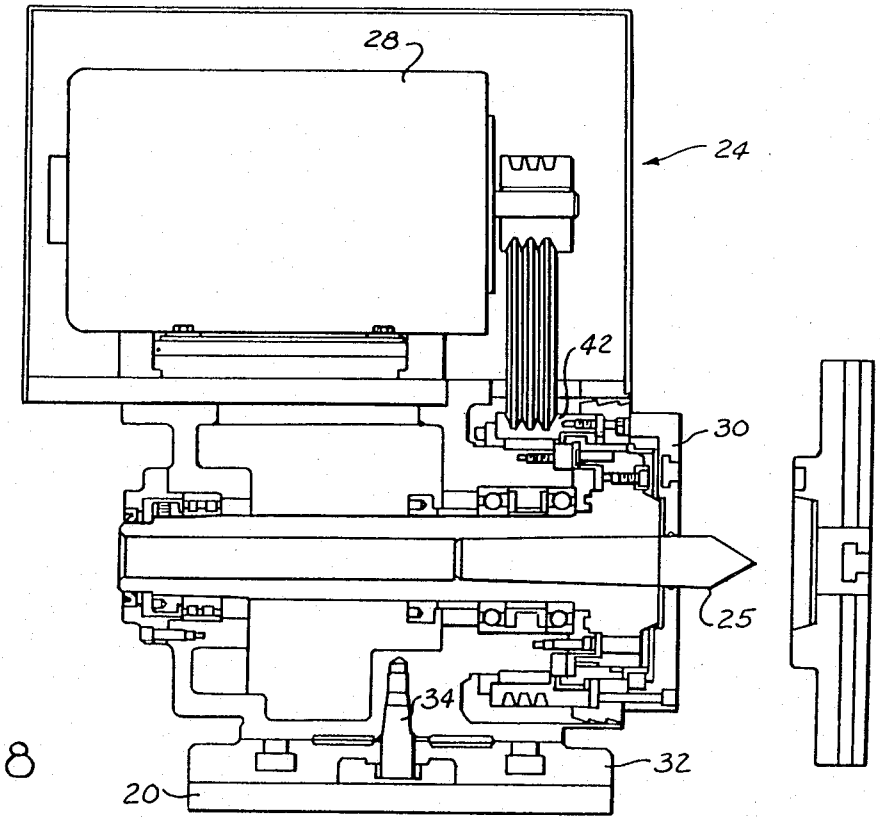
FIG. 8 is a section view through the head stock.

Footstock 26 is spaced apart from work head 24 on swivel table 20. The position of footstock 26, like work head 24, is manually adjustable longitudinally on swivel table 20. Dressing diamonds 36 and 38, as can best be seen in FIG. 6, are provided on footstock 26.

Supported from base 16 to the rear of swivel table 20 are a pair of longitudinally extending flat carrier ways 52 and 54. Flat carrier ways 52, 54 support grinding assembly 50 for longitudinal movement along base 16. A movable carriage 56 is supported from flat ways 52 and 54 for sliding movement therealong. Carriage 56 is positionable along ways 52, 54 through a preloaded nut 58 and ball screw 60 arrangement. Nut 58 is fastened to carriage 56. Ball screw 60 is rotatable by a carriage drive motor 62. Operation of carriage drive motor 62 rotates ball screw 60 to position carriage 56 along ways 52 and 54. An optical incremental encoder 64 is connected to carriage drive motor 62 to be driven in unison with ball screw 60 for providing an output which is indicative of the position of carrier 56.

A carrier traverse guide is provided for guiding the movement of carriage 56 along flat ways 52 and 54. Carriage guide 66 is engaged by sliding pads 68 and 70 which are connected to carriage 56. As carriage 56 moves along ways 52 and 54, pads 68 and 70 engage carriage guide 66 to accurately position carriage 56. Guide way 66 is accurately positioned toward the front of the grinding machine 10, vertically beneath work head 24 and footstock 26. The disclosed means of guiding carriage 56 minimizes effects of thermal and grinding load distortion and permits flat ways 52 and 54 to be utilized in place of the more conventional vee way and flat way arrangement.

A pair of slide ways 72 and 74 are provided on the top of carriage 56 and extend above and generally orthogonal to carriage ways 52 and 54. Wheel slide 76 is supported from wheel slide ways 72 and 74. Wheel slide 76 is movable back and forth on slide 72 and 74 relative to swivel table 20 by a preloaded nut 78 and ball screw 80 arrangement. Slide 76 is guided from the sides of way 72 for accurate alignment. Wheel slide drive motor 82 is connected to rotate ball screw 80 to move slide 76 to the desired position. An optical incremental encoder is mounted to servomotor 82 to be driven in unison with ball screw 80 providing an output indicative of the position of wheel slide 76.

Wheel head assembly 84 is supported by and rotatably positionable on wheel slide 76. Wheel head 84 is angularly positionable relative to wheel slide 76 about pivot connection 85. A pair of spaced apart grinding wheels 86 and 88 are mounted on spindles 90 and 92 from wheel head assembly 84. A pair of AC drive motors 94, 96 are mounted to rotate the associated grinding wheels 86, 88 by belt drives through spindles 90, 92. Wheel head 84 can be rotated to a desired position for putting either grinding wheel 86 or 88 in position for performing a desired grind. Appropriate hood arrangements 98 and 100 are provided for providing guards around grinding wheels 86 and 88 respectively. Ball screws 60 and 80 can be driven either independently or simultaneously at independent or related feed rates to provide complete two axis movement for driven grinding wheels 86, 88. Programmable microcomputer control 12 controls movement of grinding wheels 86, 88 for grinding or dressing.

In the illustrated embodiment grinding wheel 86 is an angle feed wheel head whereas grinding wheel 88 is formed as a straight feed wheel head. Grinding center 10 can be used as a straight plunge grinder or an angle wheel feed grinder, for use in a shoulder grinding, through simultaneous two-axis positioning. Drive motors 94 and 96 are $7\frac{1}{2}$ hp AC motors which drive grinding wheels 86 and 88 at a speed of approximately 8500 sfpm.

A coolant system 120 is provided having a tank with a 50 gallon capacity and a coolant flow rate of 35 gallons per minute. Flexible pipe 122 connects the coolant pump output to the wheel head 84 for supplying coolant to the appropriate grinding wheel. Coolant pipe 122 connects into coolant pipes 123, 124 which direct coolant to wheels 88, 86. By an appropriate valve arrangement coolant flow is controlled so it is only directed to the grinding wheel 86, 88 which is in position for grinding. Coolant pipes 123, 124 which supply coolant to grinding wheels 86, 88 are formed to move beneath pipe 122 when wheel head 84 is moved to a selected position.

A handwheel 102 through an appropriate gearing arrangement can be used to rotate wheel head 84 around pivot connection 86. To position wheel head 84 to a desired position bolted connections holding wheel head 84 to wheel slide 76 are loosened. Handwheel 102 is then rotated to bring wheel head 84 to the desired position. The fasteners are then tightened holding wheel head 84 and wheel slide 76 for unitary movement. Stops and markings are provided at various positions to provide for exact angular alignment of wheel head 84 relative to wheel slide 76.

Figure 9:
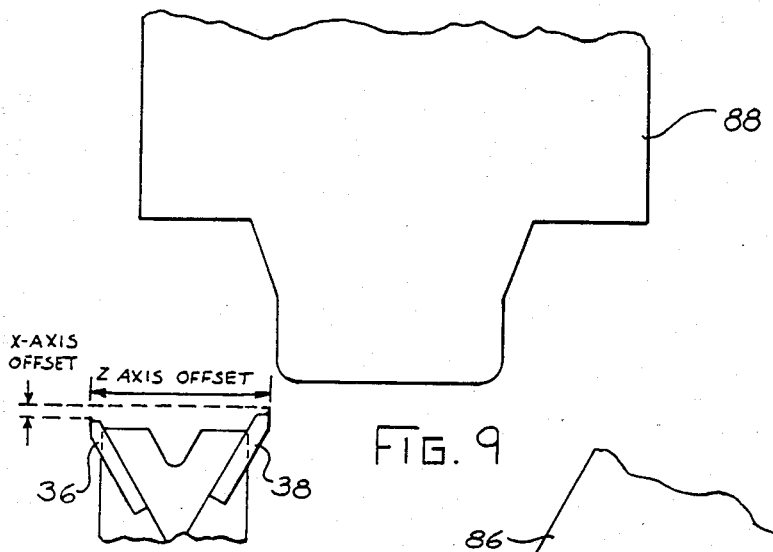
FIG. 9 is a diagramatic view of a grinding wheel disposed perpendicular to the front of the grinding center and in position for contour dressing by the pair of dressing diamonds.
Figure 10:
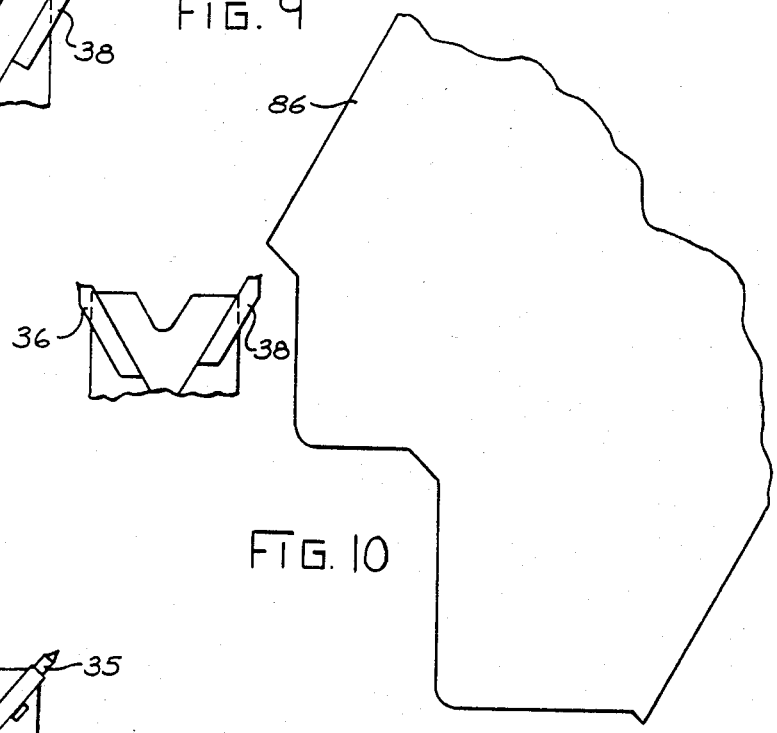
FIG. 10 is similar to FIG. 9 but for a grinding wheel disposed at an angle to the front of the grinding center; and, FIG. 11 is a diagramatic view of a single dressing diamond pivotally supported for movement to offset positions.

The two fixed dressing diamonds 36, 38 are mounted to footstock 26 for dressing grinding wheels 86 or 88. Dressing is accomplished by moving carriage 56 and wheel slide 76 along their axes at programmed rates and distances to produce the desired wheel contour which may involve combinations of straight step diameters, angles, chamfers and radii. A programmable microcomputer in controller 12 is utilized for controlling the desired movement of the wheel slide 76 and the associated grinding wheels 86 and 88. Controller 12 is programmable to provide for wheel form dressing of complex grinding wheel shapes including combinations of shoulders, diameters, fillet radii and angles connected at set inflection points. FIGS. 9 and 10 are exemplary of the various combinations of shapes which grinding center 10 can produce in grinding wheels 86, 88. It should be clearly understood, however, that these are not the limit of possible shapes and numerous other combinations of shapes can be formed.

The diamond dressing arrangement consists of the two diamonds 36 and 38 which are fixed to footstock 26 in front of the grinding wheel 86, 88. The two diamonds are offset from each other in the two planes of wheel head axes motions, along the X-axis and Z-axis. The x-axis and z-axis offsets are shown in FIG. 9. The right hand dressing diamond 38 is used for all dressing of wheel shapes, which may involve combinations of straight and increasing wheel diameter segments, as the grinding wheel 86, 88 is moved past the diamond 38 in a right to left direction (−z axis direction). The left hand dressing diamond 36 is used for all dressing of wheel shapes when the grinding wheel moves past diamond 36 in a left to right direction (+z axis direction). The wheel dressed shapes may include combinations of straight and increasing diameter segments. Of course, if necessary to achieve the desired shape, the grinding wheel may be also moved intermittently or simultaneously in the front to rear direction (x-axis direction).

The x-axis offset and the z-axis offset are measurable by touching off with the grinding wheel 86, 88 in the initial set up of grinding center 10. The x-axis and the z-axis offsets are then used to offset controller 12 such that dimensional control and blending of the wheel shape segments dressed by each diamond 36, 38 relative to the other will be achieved automatically. In actual usage of the two-diamond set up the two diamonds will not wear uniformly and this will change the x-axis and z-axis offsets between the two diamonds 36, 38. Compensation for this non-uniform diamond wear is easily achieved by adjusting the offsets in controller 12.

Figure 11:
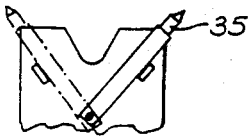

While a two dressing diamond arrangement is presently preferred, the same results could be obtained, as illustrated in FIG. 11, with a single diamond 35. Single diamond 35 is automatically swivelled from a right hand orientation to a left hand orientation when the z-axis direction of grinding wheel movement during dressing changes. Fixed stops are provided for accurately locating dressing diamond 35 in the right hand and left hand positions and the offset between these two positions can be entered into controller 12 as described previously.

Grinding center 10 has the capacity to grind different configurations using straight and angled wheel setups. Grinding center 10 combines straight slide grinding machine features and angular slide grinding machine features without the need for changing grinding wheels or reshaping grinding wheels. Contour dressing of the grinding wheels is programmable by two-axis motion to produce complex forms and eliminating the necessity for truing devices and form bars. The disclosed carriage guide system for the carriage traverse movement minimizes the effects of thermal and grinding load distortions.

We claim:

1. A grinding machine for grinding a workpiece comprising:

a base;

workpiece support means for supporting a workpiece to be ground from said base;

an indexible plate;

a first driven grinding wheel disposed on said plate;

a second driven grinding wheel, spaced apart from said first driven grinding wheel, disposed on said plate;

indexible plate support means for supporting said indexible plate for movement to a first position where said first driven grinding wheel can engage the workpiece and said second driven grinding wheel cannot and to a second position where said second driven grinding wheel can engage the workpiece and said first driven grinding wheel cannot;

a carriage supporting said indexible plate and being movable with respect to said base to move the properly positioned one of said first or second driven grinding wheels into engagement with the workpiece; and one of said first driven grinding wheel and said second driven grinding wheel is a straight feed grinding wheel and the other is an angled feed grinding wheel and further including drive means for moving said carriage along an x-axis and a z-axis;

at least a first dressing diamond supported from said base;

a programmable controller controlling said drive means for programmed movement of said carriage to dress a desired shape into said first and second driven grinding wheels.

2. A grinding machine as claimed in claim 1 comprising:

a second dressing diamond supported from said base and offset from said first dressing diamond along the z-axis and along the x-axis.

3. A grinding machine as claimed in claim 2 comprising:

a pair of ways supporting said carriage for movement along the z-axis;

an elongated guide spaced apart from said pair of ways and disposed beneath said workpiece support means for guiding movement of said carriage along the z-axis.

4. A grinding machine for grinding a workpiece comprising:

a base;

a swivel table mounted on said base;

means for supporting the workpiece disposed on said swivel table;

a wheel slide movably supported from said base;

first positioning means for moving said wheel slide on said base along a first axis;

second positioning means for moving said wheel slide on said base along a second axis which is orthogonal to said first axis;

a wheel head, having a pair of driven spaced apart grinding wheels which are disposed in a common vertical plane mounted thereon, rotatably supported from said wheel slide and positionable relative to said wheel slide to bring either one of said pair of driven grinding wheels into position for grinding the workpiece;

one of said pair of said driven spaced apart grinding wheels is a straight feed grinding wheel and the other of said pair of driven spaced apart grinding wheels is an angled feed grinding wheel.

dressing means, for dressing various shapes into each of said grinding wheels, having a first dressing position utilized for dressing changing diameter portions which extend to one side of a given said grinding wheel and a second dressing position, offset from said first dressing position, utilized for dressing changing diameter portions which extend to the other side of said given grinding wheel;

a programmable controller for controlling movement of each said driven grinding wheel in the x-axis and z-axis directions, and which during dressing, controls movement of each said driven grinding wheel to the first dressing position or the second dressing position as a function of the shape to be dressed into a portion of said driven grinding wheel.

5. A grinding machine as claimed in claim 4 comprising:

said first dressing diamond located at the first dressing position; and a second dressing diamond located at the second dressing position.

6. A grinding machine as claimed in claim 4 comprising:

pivot means supporting said dressing diamond for moving said dressing diamond to either the first said dressing position or the second said dressing position.

7. In combination with a machine for grinding a workpiece comprising a base (16), a swivel table (20) adjustably mounted on the base, a driven work head (24) disposed on the swivel table, a footstock (26) disposed on the swivel table for use with the work head to support the workpiece therebetween, and including:

a first pair of ways (52, 54) disposed on said base;

a driven carriage (56) mounted on said first pair of ways for movement therealong;

a second pair of ways (72, 74) disposed on said carriage and extending orthogonal to said first pair of ways;

a driven wheel slide (76) mounted on said second pair of ways for movement therealong;

a wheel head (84) having a pair of independently driven external grinding wheels (86, 88) mounted thereon and which is angularly positionable to bring either one of said pair of grinding wheels into position for grinding the workpiece;

longitudinal guide means (66) disposed beneath said work head and said footstock for engaging and guiding said driven carriage for movement along said first pair of ways; the improvement which comprises:

a least a first dressing diamond (36) supported from said base; and a programmable controller (12) controlling said driven carriage means for programmed movement of said carriage along the z-axis and along the x-axis to dress a desired shape into said first and second driven grinding wheels.

8. In combination with a machine for grinding a workpiece comprising a base (16), a swivel table (20) adjustably mounted on the base, a driven work head (24) disposed on the swivel table, a footstock (26) disposed on the swivel table for use with the work head to support the workpiece therebetween, a wheel head (84) having at least one independently driven external grinding wheel (86) mounted thereon and which is angularly positionable to bring said grinding wheel into position for grinding the workpiece; and at least a first dressing diamond (36) supported from said base;

the improvement which comprises means for moving said dressing diamond to traverse the grinding surface of said grinding wheel in a first direction along the z-axis of said grinding machine and in a second direction along the x-axis of said grinding machine; and means for controlling said moving means, for predetermined movement of said grinding wheel with respect to said dressing diamond along both the z-axis and the x-axis, to dress a desired complex shape into said grinding wheel.

* * * * *